US009123324B2

(12) United States Patent
Volcker

(10) Patent No.: US 9,123,324 B2
(45) Date of Patent: Sep. 1, 2015

(54) NON-LINEAR POST-PROCESSING CONTROL IN STEREO ACOUSTIC ECHO CANCELLATION

(71) Applicant: Bjorn Volcker, Mountain View, CA (US)

(72) Inventor: Bjorn Volcker, Mountain View, CA (US)

(73) Assignee: GOOGLE INC., Mountain View, CA (US)

( * ) Notice: Subject to any disclaimer, the term of this patent is extended or adjusted under 35 U.S.C. 154(b) by 288 days.

(21) Appl. No.: 13/781,365

(22) Filed: Feb. 28, 2013

(65) Prior Publication Data

US 2015/0199953 A1 Jul. 16, 2015

(51) Int. Cl.
*H04R 5/00* (2006.01)
*G10K 11/175* (2006.01)

(52) U.S. Cl.
CPC ..... *G10K 11/175* (2013.01)

(58) Field of Classification Search
CPC ..... G10K 11/175
USPC ..... 381/66, 71.1, 73.1, 94.1
See application file for complete search history.

(56) References Cited

U.S. PATENT DOCUMENTS

2006/0018457 A1* 1/2006 Unno et al. ..... 379/388.04
2007/0053524 A1* 3/2007 Haulick et al. ..... 381/92
2012/0310638 A1* 12/2012 Jeong et al. ..... 704/226

* cited by examiner

*Primary Examiner* — Paul S Kim
*Assistant Examiner* — Katherine Faley
(74) *Attorney, Agent, or Firm* — Birch, Stewart, Kolasch & Birch, LLP

(57) ABSTRACT

Methods, systems, and apparatus are provided for multiple-input multiple-output acoustic echo cancellation. A multiple-input multiple-output acoustic echo canceller (MIMO AEC) is provided as a high quality echo canceller for voice and/or audio communication over a network (e.g., packet switched network). The MIMO AEC is an extension of, as well as an application/usage of a single-input single-output acoustic echo canceller ("mono AEC"). The MIMO AEC is an extension of the mono AEC in that the code/theory underlying the mono AEC is adjusted for use with multiple channels. The manner in which AEC is applied (e.g., on each microphone signal using separate mono-AECs) is an application of mono-AECs.

20 Claims, 5 Drawing Sheets

NON-LINEAR POST-PROCESSING CONTROL IN STEREO ACOUSTIC ECHO CANCELLATION

TECHNICAL FIELD

The present disclosure generally relates to methods, systems, and apparatus for cancelling or suppressing echoes in telecommunications systems. More specifically, aspects of the present disclosure relate to multiple-input multiple-output echo cancellation using an adjustable parameter to control suppression rate.

BACKGROUND

Consider a scenario with two microphones capturing audio at client "A" and transmitting to client "B" in stereo. User "B", located at client B, now plays out the stereo signal through either stereo loudspeakers or a stereo headset. This is sometimes referred to as a "complete stereo" or "true stereo" transmission from client A to client B.

Continuing with the above scenario, assume that Acoustic Echo Cancellation (AEC) is turned on at client A. Applied on each microphone, the AEC consists of a linear filter part followed by Non-Linear Post-processing (NLP) to suppress the last residual echo. Echo cancellation on the left and right microphone signals at client A will never perform equally, since the data on each microphone are not identical. Small or larger differences in delays, microphone quality, location relative the loudspeakers and the speaker (e.g., the talker or participant), among others, will all have an impact on performance. How well the NLP will perform depends heavily on the quality of the linear filter part. Additionally, due to the differences described above, the amount of suppression that occurs on each signal will vary as well.

In one approach to NLP, user B will experience different levels of quality in the left and right channels. In a scenario where a headset is being used, this difference in quality is quite audible and fluctuations between left and right channels can be perceived (e.g., heard) by the user, which is quite annoying. Therefore, instead of enhancing the audio experience, current approaches to NLP actually result in degradation of audio quality.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

One embodiment of the present disclosure relates to a method for acoustic echo cancellation comprising: receiving audio signals at a first channel and a second channel; calculating a correlation between the audio signals received at the first channel and the second channel; determining that an overdrive parameter for the first channel is higher than an overdrive parameter for the second channel; updating the overdrive parameter for the second channel using the calculated correlation between the audio signals and the overdrive parameter of the first channel; calculating a suppression gain for the audio signal received at the first channel using the overdrive parameter for the first channel; and calculating a suppression gain for the audio signal received at the second channel using the updated overdrive parameter for the second channel.

In another embodiment, the method for acoustic echo cancellation further comprises calculating the overdrive parameters for the first channel and the second channel, wherein each of the overdrive parameters controls echo suppression rate for the respective channel.

In another embodiment of the method for acoustic echo cancellation, the step of updating the overdrive parameter for the second channel includes adjusting the overdrive parameter for the second channel by a function of the overdrive parameter for the first channel, the correlation between the audio signals, and one or more weighting terms.

In yet another embodiment, the method for acoustic echo cancellation further comprises suppressing echo in each of the audio signals using the corresponding suppression gain calculated for the audio signal.

In yet another embodiment, the method for acoustic echo cancellation further comprises sending the echo-suppressed audio signals to respective audio output devices.

In still another embodiment, the method for acoustic echo cancellation further comprises controlling echo suppression rate for the first channel and the second channel by adjusting the respective overdrive parameter.

Another embodiment of the present disclosure relates to a method for acoustic echo cancellation comprising: receiving audio signals at a first channel and a second channel; calculating a correlation between the audio signals received at the first channel and the second channel; determining that an overdrive parameter for the first channel is higher than an overdrive parameter for the second channel; updating the overdrive parameters for the first channel and the second channel; calculating a suppression gain for the audio signal received at the first channel using the updated overdrive parameter for the first channel; and calculating a suppression gain for the audio signal received at the second channel using the updated overdrive parameter for the second channel.

In one or more other embodiments, the methods presented herein may optionally include one or more of the following additional features: the overdrive parameter for the first channel remains unchanged; the one or more weighting terms are functions of the suppression level of each of the channels; the one or more weighting terms are the suppression level of each of the channels averaged over a set of sub-bands; the first channel and the second channel are neighboring channels of a plurality of channels; and/or the first channel and the second channel are near-end channels in a communication pathway.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
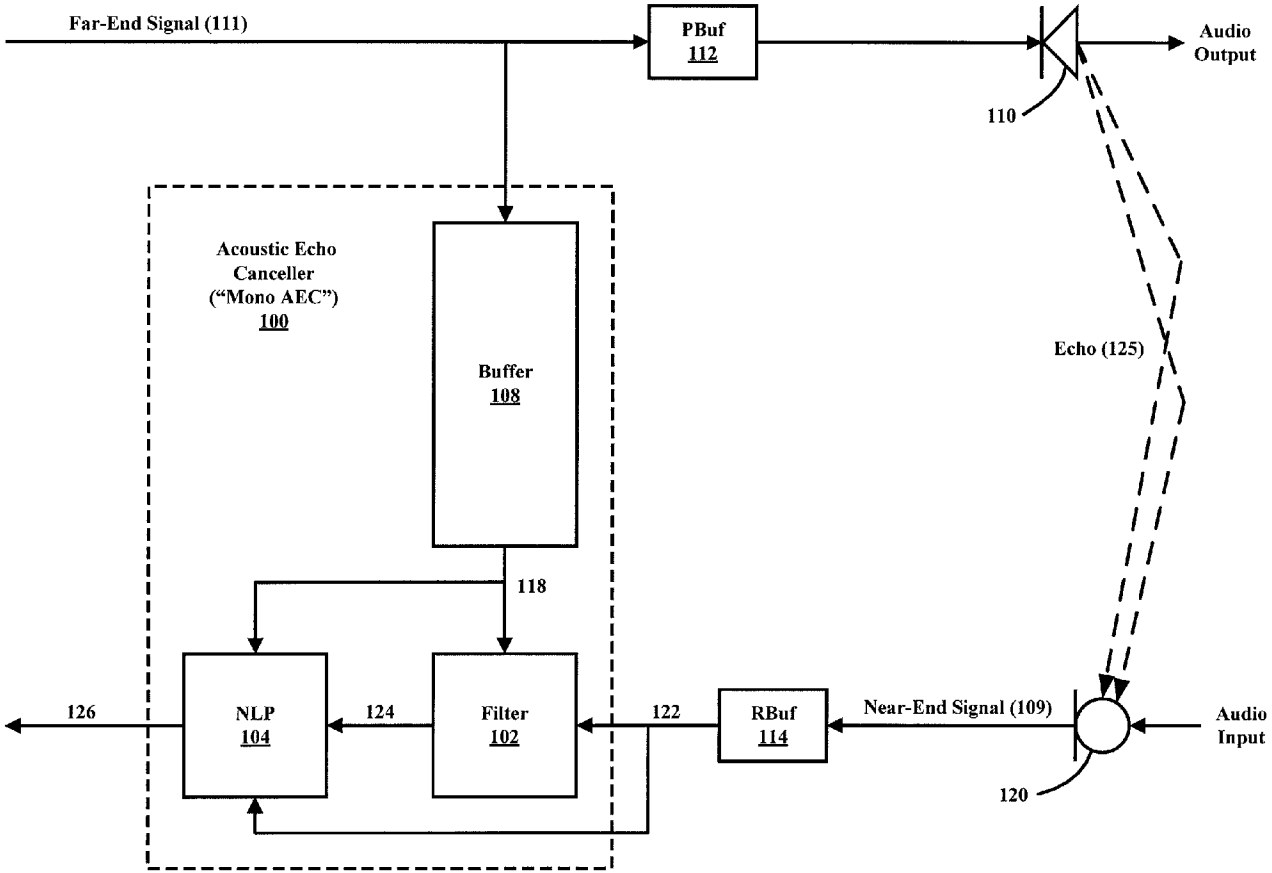
FIG. 1 is a block diagram illustrating an example of an existing single-input single-output acoustic echo canceller.

The headings provided herein are for convenience only and do not necessarily affect the scope or meaning of the claimed invention.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various embodiments and examples will now be described. The following description provides specific details for a thorough understanding and enabling description of these examples. One skilled in the relevant art will understand, however, that the embodiments described herein may be practiced without many of these details. Likewise, one skilled in the relevant art will also understand that the embodiments described herein can include many other obvious features not described in detail herein. Additionally, some well-known structures or functions may not be shown or described in detail below, so as to avoid unnecessarily obscuring the relevant description.

Embodiments of the present disclosure relate to methods, systems, and apparatus for multiple-input multiple-output acoustic echo cancellation. In particular, the present disclosure describes in detail the design, operation, and implementation of a multiple-input multiple-output acoustic echo canceller (hereafter referred to as "MIMO AEC" for purposes of brevity).

Figure 2:
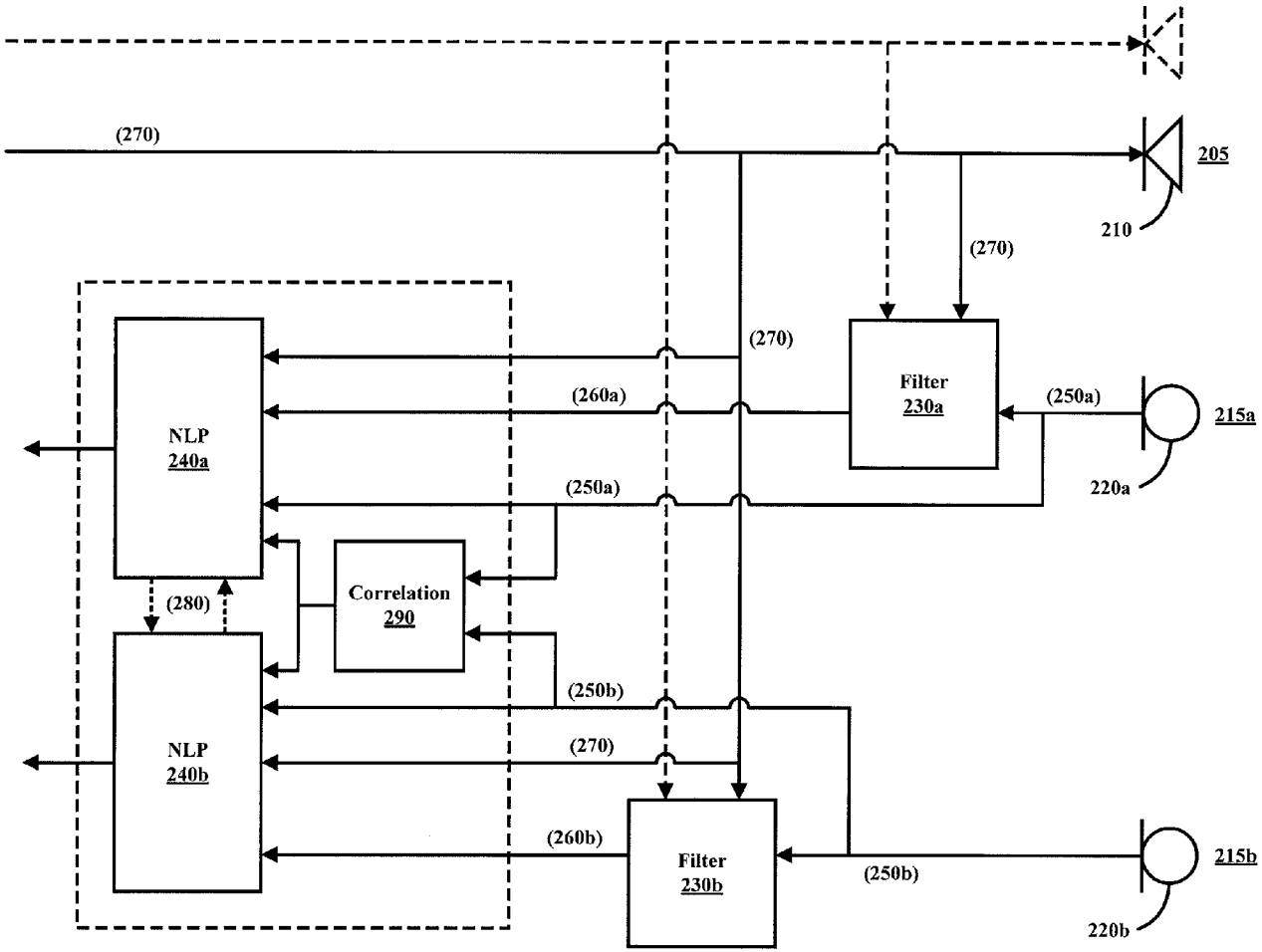
FIG. 2 is a block diagram illustrating an example multiple-input multiple-output acoustic echo canceller according to one or more embodiments described herein.

Referring to the system illustrated in FIG. 2, because acoustic echo cancellation operates independently on each audio channel (e.g., microphone) being used, each corresponding audio signal will be of different quality (e.g., the audio signals across different channels will not have identical characteristics). For example, the audio level of the signal of the left channel may be higher/lower than the audio level of the signal at the right channel. Such differences in audio levels can impact various audio processing operations that are then performed on the signals. For example, if the amount of echo suppression/cancellation performed on, for example, the left channel signal is less than that performed on the right channel signal, the user may perceive a slight echo in the audio at the left channel while the audio at the right channel sounds close to perfect. Not only is this perceived echo annoying to the user, but if the audio at the right channel sounds excellent, then the user will want the audio at the left channel to sound equally as good.

The MIMO AEC of the present disclosure is designed as a high quality echo canceller for voice and/or audio communication over a network (e.g., packet switched network). As will be further described herein, the MIMO AEC is an extension of, as well as an application/usage of a single-input single-output acoustic echo canceller (hereafter referred to as "mono AEC" for purposes of clarity and brevity). The MIMO AEC provided herein is an extension of the mono AEC in that the code/theory underlying the mono AEC is adjusted for use with multiple channels (e.g., extending equation (1), presented below, to work for multiple-input multiple-output, as described with respect to equation (2), also presented below).

The manner in which AEC is applied in various embodiments described herein (e.g., on each microphone signal using separate mono-AECs) is not so much an extension of mono AEC, but rather an application of mono-AECs.

The following is a brief overview of some of the differences between the MIMO AEC of the present disclosure and a mono AEC. This is not an exhaustive identification of all of the differences between the MIMO AEC and a mono AEC, but instead is provided as an introduction to some of the features of the MIMO AEC, each of which is further described below. As compared to the mono AEC, the MIMO AEC includes extended channel filters to match all possible combinations between loudspeakers and microphones. For example, in a scenario involving two loudspeakers and two microphones, there are four different ways (e.g., combinations) the audio waves can propagate, from left loudspeaker to right microphone, from right loudspeaker to left microphone, and so on. In the MIMO AEC, the non-linear processor (NLP) may be configured to incorporate correlation between far-end channels, incorporate correlation between near-end channels, and/or level out differences in echo suppression between near-end channels. Also, in operation, the MIMO AEC calculates coherence by taking multiple loudspeakers into account. Numerous other features of the MIMO AEC, as well as additional differences between the MIMO AEC and a mono AEC, will be described in greater detail below.

In one or more embodiments, the echo suppression rate/aggressiveness in the MIMO AEC may be controlled by one overdrive parameter per channel. The overdrive parameter can be adjusted for a specific channel (e.g., left channel, right channel, etc.) by accounting for the correlation between the specific channel and one or more of the other channels. For example, if the correlation between two microphone channels (or signals, as a channel may be referenced by the corresponding signal being transmitted by it) is high and there is a strong echo present in one channel, then there will also be a strong echo present in the other channel. Accordingly, the better of the two channels can be left as is while the contribution from that channel's strong overdrive is factored into the weaker overdrive of the other channel. Additional details regarding the overdrive parameter, channel correlation, and controlling the echo suppression rate/aggressiveness in the MIMO AEC will be provided below.

FIG. 1 is a block diagram illustrating an example mono AEC and surrounding environment. Because certain features and functions of the MIMO AEC described herein are extensions and/or variations of similar such features and functions as they exist in a mono AEC, the following description of the example mono AEC illustrated in FIG. 1 is helpful in understanding the design of the MIMO AEC. In one or more embodiments, the MIMO AEC may include some or all of the components of the mono AEC shown in FIG. 1 and described in detail below. However, it should be noted that there are important differences between the MIMO AEC of the present disclosure and a mono AEC such as that illustrated in FIG. 1. Therefore, the following description of various components and features of the mono AEC is not in any way intended to limit the scope of the present disclosure.

The mono AEC 100, like the MIMO AEC, is designed as a high quality echo canceller for voice and/or audio communications over a network (e.g., packet switched network). More specifically, the AEC 100 is designed to cancel acoustic echo 125 that emerges due to the reflection of sound waves output by a render device 110 (e.g., a loudspeaker) from boundary surfaces and other objects back to a near-end capture device 120 (e.g., a microphone). The echo 125 may also exist due to the direct path from the render device 110 to the capture device 120.

Render device 110 may be any of a variety of audio output devices, including a loudspeaker or group of loudspeakers configured to output sound from one or more channels. Capture device 120 may be any of a variety of audio input devices, such as one or more microphones configured to capture sound and generate input signals. For example, render device 110 and capture device 120 may be hardware devices internal to a computer system, or external peripheral devices connected to a computer system via wired and/or wireless connections. In some arrangements, render device 110 and capture device 120 may be components of a single device, such as a microphone, telephone handset, etc. Additionally, one or both of render device 110 and capture device 120 may include analog-to-digital and/or digital-to-analog transformation functionalities.

With reference again to FIG. 1, the mono AEC 100 may include a linear filter 102, a nonlinear processor (NLP) 104, and a buffer 108. A far-end signal 111 generated at the far-end of the signal transmission path and transmitted to the near-end may be input to the filter 102 via the buffer 108, which may be configured to feed blocks of audio data to the filter 102 and the NLP 104. The far-end signal 111 may also be input to a play-out buffer (PBuf) 112 located in close proximity to the render device 110. The far-end signal 111 may be input to the buffer 108 and the output signal 118 of the buffer may be input to the linear filter 102, and to the NLP 104.

In the mono AEC 100 shown in FIG. 1, and in at least one embodiment of the MIMO AEC, the linear filter (e.g., linear filter 102 as shown in FIG. 1 and linear filters 230*a* and 230*b* as shown in FIG. 2) is an adaptive filter. Linear filter 102 operates in the frequency domain through, e.g., the Discrete Fourier Transform (DFT). The DFT may be implemented as a Fast Fourier Transform (FFT). As will be further described below, in one or more embodiments the MIMO AEC includes one filter for each render device and capture device combination (e.g., for each loudspeaker-microphone combination). Additionally, in one or more embodiments described herein, in the adaptive filter (e.g., Normalized Least Means Square (NLMS) algorithm) of the MIMO AEC, the normalization is performed over all far-end channels (e.g., an averaged power). It should be noted that while the linear filter may be an adaptive filter, it is also possible for the filter to be a static filter without in any way departing from the scope of the present disclosure.

Another input to the linear filter 102 is the near-end signal 122 from the capture device 120 via a recording buffer 114. The capture device 120 may receive audio input, which may include, for example, speech, and also the echo 125 from the audio output of the render device 110. The capture device may send the audio input and echo 125 as near-end signal 109 to the recording buffer 114. The NLP 104 may receive three signals as input: (1) the far-end signal 111 via buffer 108, (2) the near-end signal 122 via the recording buffer 114, and (3) the output signal 124 of the filter 102. The output signal 124 from the filter 102 may also be referred to as an error signal. In a case where the NLP 104 attenuates the output signal 124, a comfort noise signal may be generated. Comfort noise may also be generated in the MIMO AEC. For example, in at least one embodiment, one comfort noise signal may be generated for each channel, or the same comfort noise signal may be generated for both channels.

FIG. 2 is a block diagram illustrating an example MIMO AEC according to one or more embodiments described herein. In at least one embodiment, the MIMO AEC is located in an end-user device, such as a personal computer (PC). The example arrangement illustrated in FIG. 2 includes far-end channel 205 with render device 210, and near-end channels 215*a* and 215*b*, which are fed by capture devices 220*a* and 220*b*, respectively.

Render device 210 at far-end channel 205 and/or one or both of capture devices 220*a* and 220*b* at near-end channels 215*a* and 215*b*, respectively, may include one or more similar features as render device 110 and capture device 120 described above with respect to FIG. 1. Furthermore, any additional render and/or capture devices that may be used in the example arrangement shown in FIG. 2 (e.g., the additional far-end render device represented by a broken line) may also have one or more features similar to either or both of render device 110 and capture device 120 as shown in FIG. 1.

In at least the example embodiment shown in FIG. 2, the MIMO AEC includes a linear adaptive filter (e.g., 230*a*, 230*b*) and a non-linear suppressor (e.g., 240*a*, 240*b*) for each near-end channel (e.g., 215*a*, 215*b*).

In another embodiment, the MIMO AEC may include one or more far-end buffers (not shown) that store the far-end channel 205. Additionally, any or all of the non-linear suppressors 240*a* and 240*b* may include a comfort noise generator. For example, in a scenario where a non-linear suppressor 240*a*, 240*b* suppresses the near-end signal, comfort noise may be generated by the non-linear suppressor 240*a*, 240*b*.

All signals from the far-end channel 205 are fed as inputs (270) to each of the adaptive filters 230*a* and 230*b*, and also to each of the non-linear suppressors 240*a* and 240*b*. Another input to each of the filters 230*a* and 230*b*, as well as each of the non-linear suppressors 240*a* and 240*b*, is the near-end signal (250*a*, 250*b*) from the channel-specific audio input devices (e.g., microphones) 220*a* and 220*b*, which correspond to near-end channels 215*a* and 215*b*, respectively. Each of the non-linear suppressors 240*a* and 240*b* operates on the output (260*a*, 260*b*) of its respective adaptive filter 230*a* or 230*b*, as well as the inputs (270) from the far-end channel 205 and its respective near-end signal 250*a* or 250*b*. The non-linear suppressors 240*a* and 240*b* may also receive input from a correlation component 290, which operates on the near-end signals 250*a* and 250*b* from the channel-specific audio input devices 220*a* and 220*b*, respectively. In at least one embodiment, each of the non-linear suppressors 240*a* and 240*b* takes the other channels into consideration when performing various processing on the output (260*a*, 260*b*) received from the adaptive filters 230*a* and 230*b*.

It should be noted that the nonlinear suppressors 240*a*, 240*b* may receive one or more other inputs not shown in FIG. 2. Also, depending on the implementation, the correlation component 290 may calculate the correlation between the near-end signals 250*a* and 250*b* as an internal component of the non-linear suppressors 240*a*, 240*b*, or instead may calculate the correlation independently of (e.g., externally from) the non-linear suppressors 240*a* and 240*b*.

In accordance with at least one embodiment, information 280 may be passed between the non-linear suppressors 240*a*, 240*b* (such information exchange is not present in the example mono AEC shown in FIG. 1). This meta information can consist of suppression rate or overdrive of each non-linear suppressor (e.g., 240*a*, 240*b*). In addition, the other near-end signals (e.g., 250*a*, 250*b*) may also be included in the meta information exchanged between the non-linear suppressors 240*a*, 240*b*, for example, to calculate the cross-correlation between the channels (e.g., 215*a* and 215*b*).

It should be noted that although FIG. 2 illustrates the example MIMO AEC with two near-end channels (e.g., near-end channels 215*a* and 215*b*) and one far-end channel (e.g., far-end channel 205), the MIMO AEC described herein may also be used with one or more other near-end channels and/or far-end channels in addition to or instead of the channels shown.

In one or more embodiments, each of NLP 240*a* and 240*b* uses coherence measures between the microphone signal and the error signal (e.g., after FLMS), $c_{de}$, and between the far-end and near-end, $c_{xd}$. Because post-processing is performed on each channel, $c_{xd}$ does not change between the mono AEC and the MIMO AEC. However, $c_{xd}$ does change between the mono AEC and MIMO AEC in an environment where multiple render devices 210 are being utilized. For example, with the mono AEC, this coherence measure is calculated as the following:

$$c_{xd} = \frac{|S_{X_k D_k}(n)|^2}{S_{X_k X_k}(n) S_{D_k D_k}^{*}(n)}, \tag{1}$$

where S are power spectral densities (PSD) for each frequency sub-band (e.g., frequency bin) and time block k.

For the MIMO AEC, as described herein, the far-end correlation should also be taken into account. For example, for each near-end channel (l) (e.g., each of near-end channels 215*a* and 215*b*, as shown in the example arrangement of FIG. 2) and for each frequency sub-band (n), equation (1) should be re-written into the following:

$$c_{xd}^{l}(n) = \frac{S_{xd^l}^{*}(n) S_x^{-1}(n) S_{xd^l}(n)}{D_{dl}(n)} \tag{2}$$

where $S_{xd^l}(n)$ is the complex valued cross-PSD (vector) between the far-end channels (e.g., far-end channel 205 and at least one additional far-end channel represented by a broken line in FIG. 2) and the near-end channel number l. Furthermore, $S_x(n)$ is the cross-PSD (matrix) between the far-end channels, and $S_{d^l}(n)$ is the PSD of the near-end channel number l. To clarify, with respect to equation (1), there is one calculation of equation (1) performed for each channel l and time k. Furthermore, $S_{xd^l}(n)$ is the same as element n of $S_{XD}$ in equation (1). $S_x(n)$ and $S_{d^l}(n)$ follow accordingly.

In at least one embodiment of the MIMO AEC, both the suppression level $s_v(n)$ and the overdrive γ may be calculated independently for each channel with one exception. Prior to smoothing, the overdrives may be adjusted to level-out possible differences between channels and weight-in more reliable decisions to other channels.

For purposes of illustration, consider the stereo case only and order the channel overdrives (e.g., before smoothing) as $\gamma_l$ (lowest value) and $\gamma_h$ (highest value). The highest value will be left unchanged ($\gamma=\gamma_h$) while the lowest overdrive value $\gamma_l$ will be adjusted by the largest value as:

$$\gamma = \gamma_l + \rho_{dd}(k)\frac{w_h(k)\gamma_h - w_l(k)\gamma_l}{w_l(k) + w_h(k)} \tag{3}$$

where $\rho_{dd}(k)$ is the correlation between the input (e.g., microphone) signals (which will be explained in greater detail below) and $w_l(k)$, $w_h(k)$ are weights based on the cancellation quality. Here, w(k) represents the overall suppression levels and therefore a smaller value for w(k) translates to higher quality. For example, in at least one embodiment, the weights are determined based on the suppression levels calculated over a sub-band $K=\{n|n_0 \le n \le n_1\}$ as follows:

$$w_l(k) = \sum_{n\in K} s_l(n) \tag{4}$$

$$w_H(k) = \sum_{n\in K} s_H(n) \tag{5}$$

In one or more embodiments, the sub-band described above is the same as that used to obtain an average coherence value in the mono AEC.

Additionally, the microphone signal correlation $\rho_{dd}(k)$ is a slightly modified correlation measure, and may be obtained as the following:

$$P_{D_k^l D_k^h} = \gamma_S P_{D_{k-1}^l D_{k-1}^h} + (1-\gamma_S)\left(|D_k^l| - \frac{1}{N}\sum_n |D_k^l(n)|\right)\circ\left(|D_k^h| - \frac{1}{N}\sum_n |D_k^h(n)|\right) \tag{6}$$

$$\rho_{dd}(k) = \frac{1^T P_{D_k^l D_k^h}}{\sqrt{\left\|S_{D_k^l D_k^l}\right\|_1 \left\|S_{D_k^j D_k^h}\right\|_1}}$$

Figure 3:
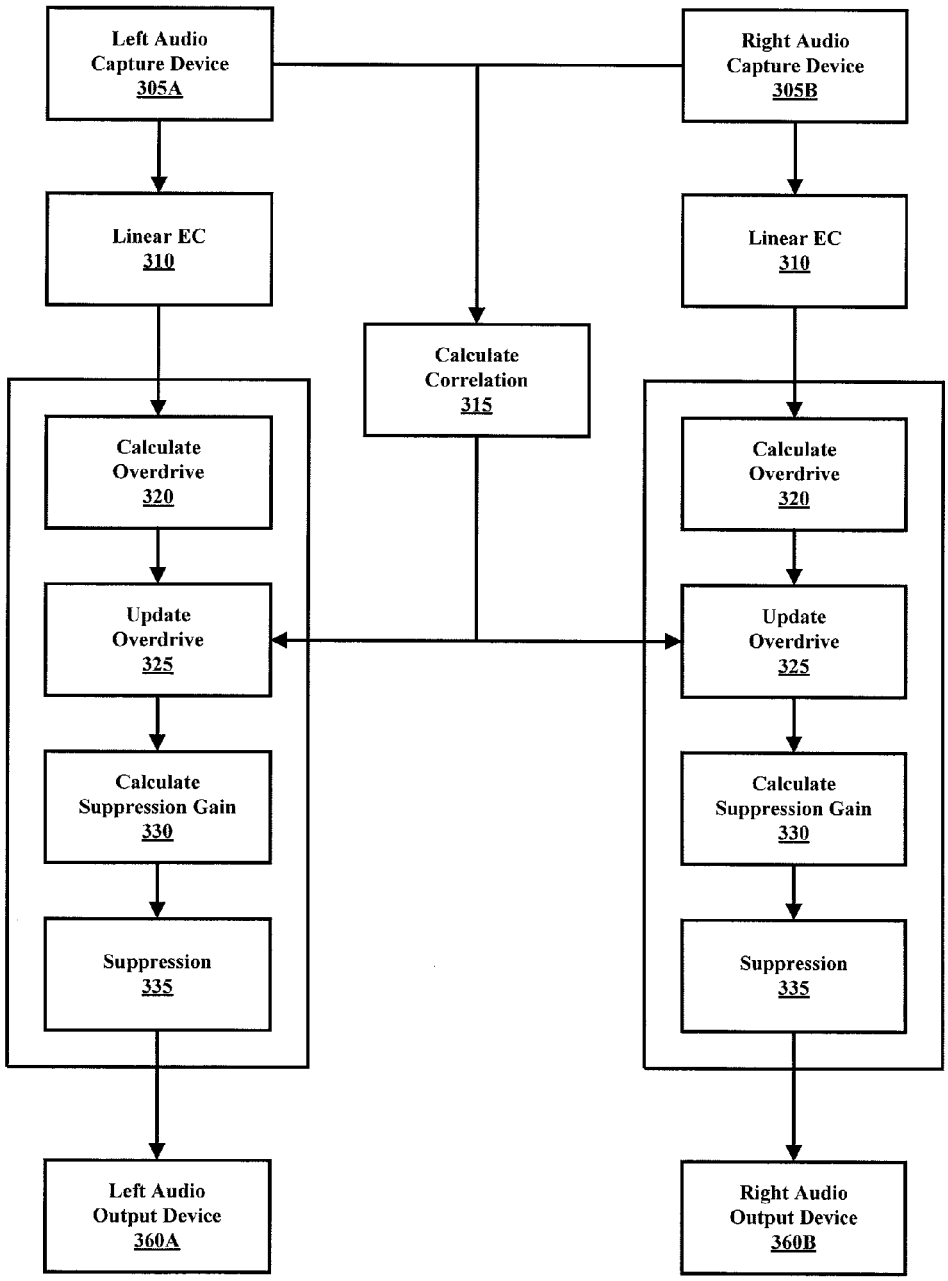
FIG. 3 is a flowchart illustrating an example method for multiple-input multiple-output echo cancellation using an overdrive parameter to control suppression rate according to one or more embodiments described herein.

FIG. 3 illustrates an example process for multiple-input multiple-output echo cancellation according to one or more embodiments described herein. As will be further described below, the process may utilize an overdrive parameter to control suppression rate.

At blocks 305A and 3055B, an incoming audio signal may be captured by left and right audio capture devices, respectively. The captured signals may be processed through echo control processing at blocks 310, and may also separately be passed to block 315 for use in calculating correlation between the signals.

Overdrive parameters may be calculated at blocks 320 and then may be updated at blocks 325 using the calculated correlation between the signals from block 315. The updated overdrive parameters from blocks 325 may be used at blocks 330 to calculate the suppression gain for each of the signals. At blocks 335, the calculated suppression gains may be applied to the signals to suppress echo. The echo-suppressed signals may then be passed to the left and right audio output devices at blocks 360A and 360B, respectively.

Figure 4:
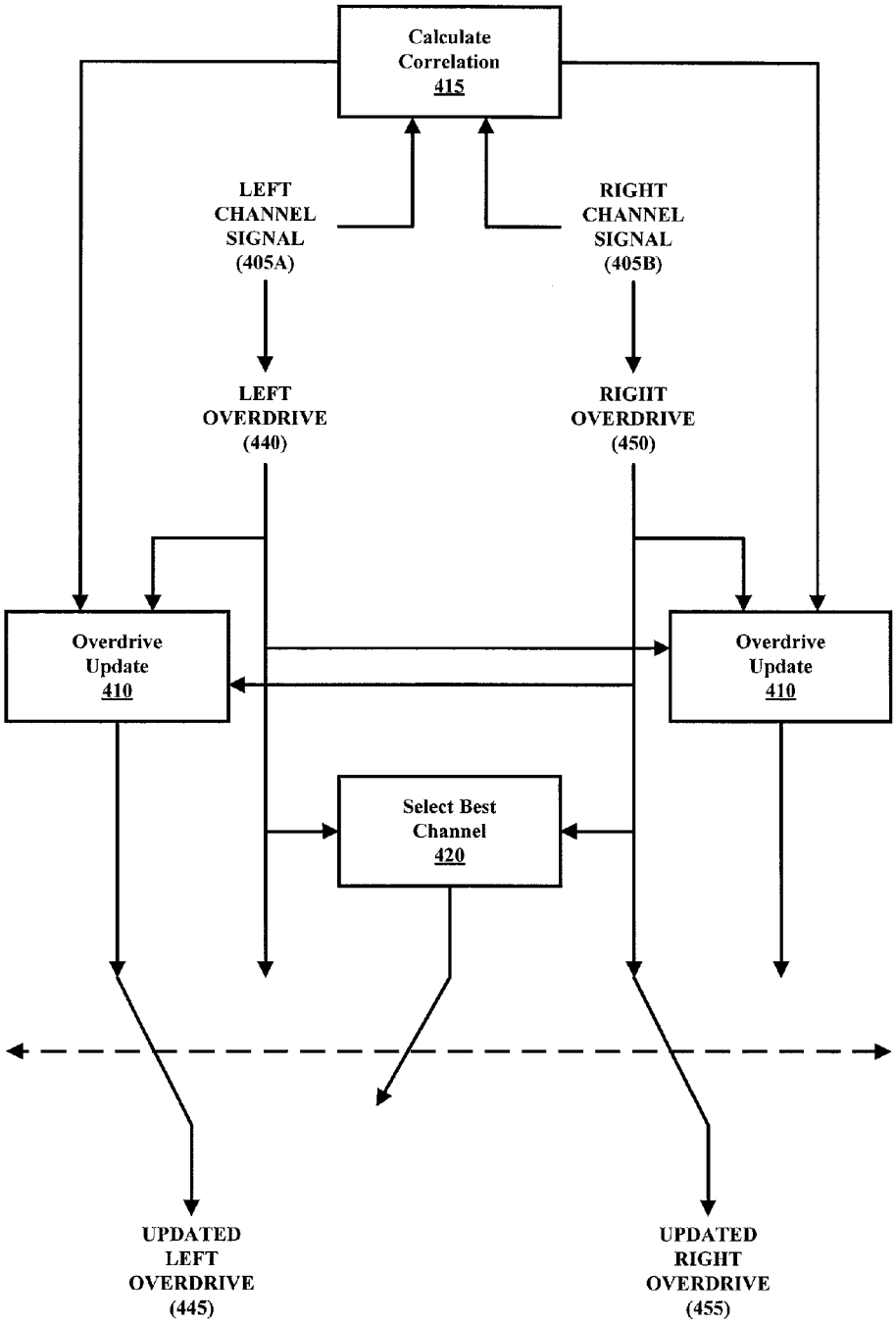
FIG. 4 is block diagram illustrating example computational stages for updating an overdrive parameter to control suppression rate according to one or more embodiments described herein.

FIG. 4 illustrates example computational stages for updating an overdrive parameter to control suppression rate according to one or more embodiments described herein.

Overdrive parameters 440 and 450 may be provided for the left and right channels 405A, 405B, respectively, to control the echo suppression rate/aggressiveness in the MIMO AEC (e.g., the model MIMO AEC as shown in the example of FIG. 2). Each of the overdrive parameters 440, 450 may be inputs to both of the overdrive updates 410 performed for the left and right channels 405A and 405B. In one example, the overdrive parameters 440, 450 passed as input to each of the overdrive updates 410 may be meta information exchanged between non-linear suppressors (e.g., meta information 280 exchanged between non-linear suppressors 240*a* and 240*b*, as shown in the example of FIG. 2).

Additionally, each of the overdrive parameters 440. 450 may be adjusted/updated 410 for their respective channels (e.g., left channel 405A, right channel 405B, etc.) by accounting for the correlation 415 between the channels (as well as the correlation between each of their respective channels and one or more other channels that may be present). In accordance with at least one embodiment, the left and right signals 405A, 405B may also be included in meta information (e.g., meta information 280) exchanged between non-linear suppressors to, for example, calculate the cross-correlation between the signals.

In a scenario where there is high correlation 415 between the left channel 405A and the right channel 405B, and there is a strong echo present in one of the channels, then there will also be a strong echo present in the other channel. Accordingly, the better of the two channels 405A, 405B can be left as is while the contribution from that better channel's strong overdrive is factored into the weaker overdrive of the other channel.

In the example shown in FIG. 4, the right channel 405B is selected (e.g., determined) as the better channel 420 between the left and right channels 405A, 405B. As such, the right overdrive 450 remains as is and passes untouched as the updated right overdrive 455. The contribution from the right overdrive 450 may be used in the overdrive update 410 for the left channel 405A to strengthen the left overdrive 440 and output an updated left overdrive 445.

Figure 5:
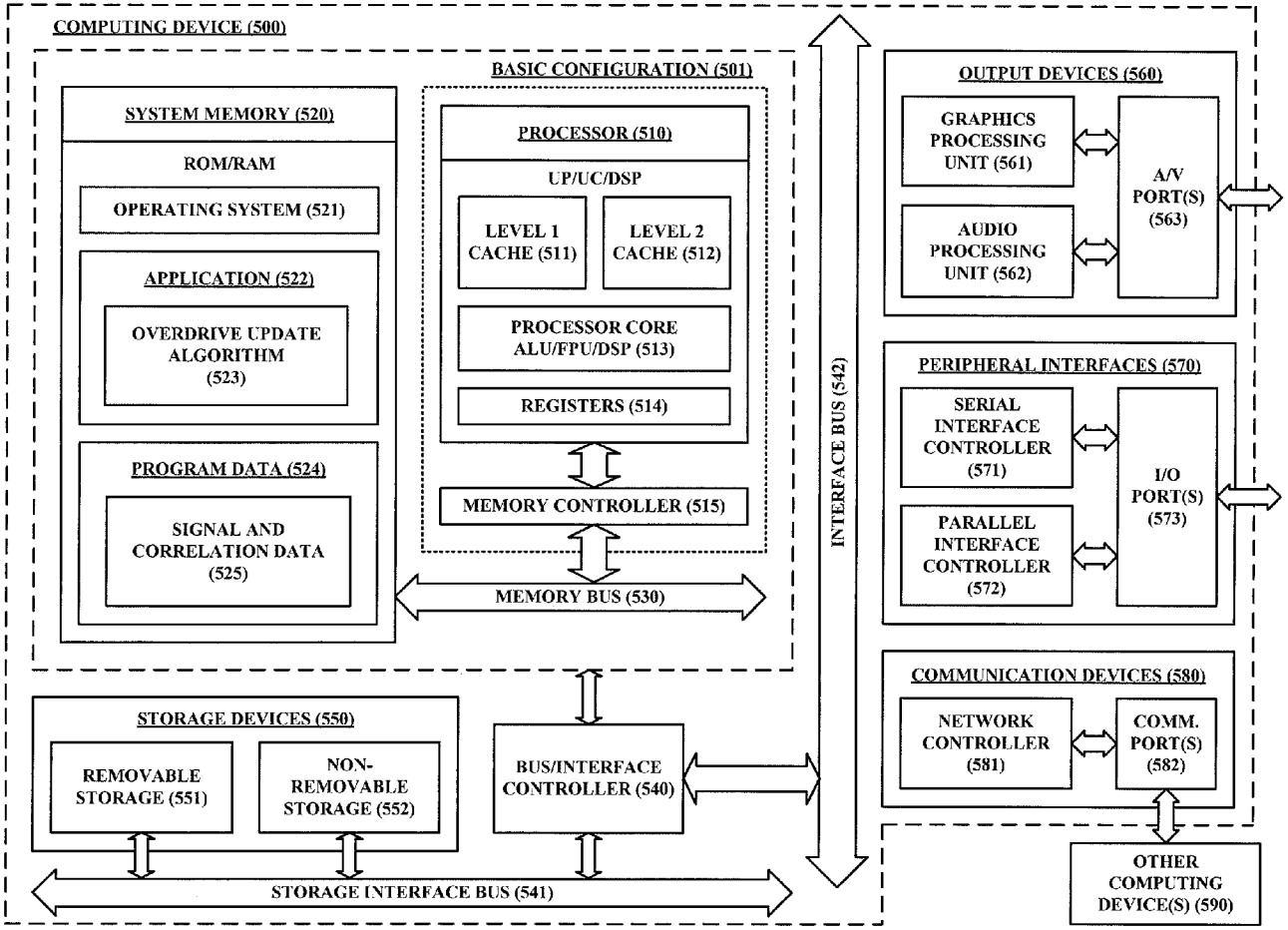
FIG. 5 is a block diagram illustrating an example computing device arranged for multiple-input multiple-output echo cancellation using an overdrive parameter to control suppression rate according to one or more embodiments described herein.

FIG. 5 is a block diagram illustrating an example computing device 500 that is arranged for multiple-input multiple-output echo cancellation using an overdrive parameter to control suppression rate in accordance with one or more embodiments of the present disclosure. In a very basic configuration 501, computing device 500 typically includes one or more processors 510 and system memory 520. A memory bus 530 may be used for communicating between the processor 510 and the system memory 520.

Depending on the desired configuration, processor 510 can be of any type including but not limited to a microprocessor (μP), a microcontroller (μC), a digital signal processor (DSP), or any combination thereof. Processor 510 may include one or more levels of caching, such as a level one cache 511 and a level two cache 512, a processor core 513, and registers 514. The processor core 513 may include an arithmetic logic unit (ALU), a floating point unit (FPU), a digital signal processing core (DSP Core), or any combination thereof. A memory controller 515 can also be used with the processor 510, or in some embodiments the memory controller 515 can be an internal part of the processor 510.

Depending on the desired configuration, the system memory 520 can be of any type including but not limited to volatile memory (e.g., RAM), non-volatile memory (e.g., ROM, flash memory, etc.) or any combination thereof. System memory 520 typically includes an operating system 521, one or more applications 522, and program data 524. In at least some embodiments, application 522 includes a multipath routing algorithm 523 that is configured to receive and store audio frames based on one or more characteristics of the frames (e.g., encoded, decoded, contain VAD decision, etc.). The multipath routing algorithm is further arranged to identify candidate sets of audio frames for consideration in a mixing decision (e.g., by an audio mixer, such as example audio mixer 230 shown in FIG. 2) and select from among those candidate sets audio frames to include in a mixed audio signal (e.g., mixed audio signal 125 shown in FIG. 1) based on information and data contained in the audio frames (e.g., VAD decisions).

Program Data 524 may include multipath routing data 525 that is useful for identifying received audio frames and categorizing the frames into one or more sets based on specific characteristics (e.g., whether a frame is encoded, decoded, contains a VAD decision, etc.). In some embodiments, application 522 can be arranged to operate with program data 524 on an operating system 521 such that a received audio frame is analyzed to determine its characteristics before being stored in an appropriate set of audio frames (e.g., decoded frame set 270 or encoded frame set 275 as shown in FIG. 2).

Computing device 500 can have additional features and/or functionality, and additional interfaces to facilitate communications between the basic configuration 501 and any required devices and interfaces. For example, a bus/interface controller 540 can be used to facilitate communications between the basic configuration 501 and one or more data storage devices 550 via a storage interface bus 541. The data storage devices 550 can be removable storage devices 551, non-removable storage devices 552, or any combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), tape drives and the like. Example computer storage media can include volatile and nonvolatile, removable and non-removable media implemented in any method or technology for storage of information, such as computer readable instructions, data structures, program modules, and/or other data.

System memory 520, removable storage 551 and non-removable storage 552 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 500. Any such computer storage media can be part of computing device 500.

Computing device 500 can also include an interface bus 542 for facilitating communication from various interface devices (e.g., output interfaces, peripheral interfaces, communication interfaces, etc.) to the basic configuration 501 via the bus/interface controller 540. Example output devices 560 include a graphics processing unit 561 and an audio processing unit 562, either or both of which can be configured to communicate to various external devices such as a display or speakers via one or more A/V ports 563. Example peripheral interfaces 570 include a serial interface controller 571 or a parallel interface controller 572, which can be configured to communicate with external devices such as input devices (e.g., keyboard, mouse, pen, voice input device, touch input device, etc.) or other peripheral devices (e.g., printer, scanner, etc.) via one or more I/O ports 573.

An example communication device 580 includes a network controller 581, which can be arranged to facilitate communications with one or more other computing devices 590 over a network communication (not shown) via one or more communication ports 582. The communication connection is one example of a communication media. Communication media may typically be embodied by computer readable instructions, data structures, program modules, or other data in a modulated data signal, such as a carrier wave or other transport mechanism, and includes any information delivery media. A "modulated data signal" can be a signal that has one or more of its characteristics set or changed in such a manner as to encode information in the signal. By way of example, and not limitation, communication media can include wired media such as a wired network or direct-wired connection, and wireless media such as acoustic, radio frequency (RF), infrared (IR) and other wireless media. The term computer readable media as used herein can include both storage media and communication media.

Computing device 500 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 500 can also be implemented as a personal computer including both laptop computer and non-laptop computer configurations.

There is little distinction left between hardware and software implementations of aspects of systems; the use of hardware or software is generally (but not always, in that in certain contexts the choice between hardware and software can become significant) a design choice representing cost versus efficiency tradeoffs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation. In one or more other scenarios, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those skilled within the art that each function and/or operation within such block diagrams, flowcharts, or examples can be implemented, individually and/or collectively, by a wide range of hardware, software, firmware, or virtually any combination thereof.

In one or more embodiments, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments described herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof. Those skilled in the art will further recognize that designing the circuitry and/or writing the code for the software and/or firmware would be well within the skill of one of skilled in the art in light of the present disclosure.

Additionally, those skilled in the art will appreciate that the mechanisms of the subject matter described herein are capable of being distributed as a program product in a variety of forms, and that an illustrative embodiment of the subject matter described herein applies regardless of the particular type of signal-bearing medium used to actually carry out the distribution. Examples of a signal-bearing medium include, but are not limited to, the following: a recordable-type medium such as a floppy disk, a hard disk drive, a Compact Disc (CD), a Digital Video Disk (DVD), a digital tape, a computer memory, etc.; and a transmission-type medium such as a digital and/or an analog communication medium (e.g., a fiber optic cable, a waveguide, a wired communications link, a wireless communication link, etc.).

Those skilled in the art will also recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. A method for acoustic echo cancellation, the method comprising:

receiving audio signals at a first channel and a second channel;

calculating, using a non-linear processor, a correlation between the audio signals received at the first channel and the second channel;

determining that an overdrive parameter for the first channel is higher than an overdrive parameter for the second channel;

updating the overdrive parameter for the second channel using the calculated correlation between the audio signals and the overdrive parameter of the first channel;

calculating a suppression gain for the audio signal received at the first channel using the overdrive parameter for the first channel; and calculating a suppression gain for the audio signal received at the second channel using the updated overdrive parameter for the second channel.

2. The method of claim 1, further comprising calculating the overdrive parameters for the first channel and the second channel, wherein each of the overdrive parameters controls echo suppression rate for the respective channel.

3. The method of claim 1, wherein the overdrive parameter for the first channel remains unchanged.

4. The method of claim 1, wherein updating the overdrive parameter for the second channel includes adjusting the overdrive parameter for the second channel by a function of the overdrive parameter for the first channel, the correlation between the audio signals, and one or more weighting terms.

5. The method of claim 4, wherein the one or more weighting terms are functions of a suppression level of each of the channels.

6. The method of claim 4, wherein the one or more weighting terms are a suppression level of each of the channels averaged over a set of sub-bands.

7. The method of claim 1, wherein the first channel and the second channel are neighboring channels of a plurality of channels.

8. The method of claim 1, further comprising suppressing echo in each of the audio signals using the corresponding suppression gain calculated for the audio signal.

9. The method of claim 8, further comprising sending the echo-suppressed audio signals to respective audio output devices.

10. The method of claim 1, further comprising controlling echo suppression rate for the first channel and the second channel by adjusting the respective overdrive parameter.

11. The method of claim 1, wherein the first channel and the second channel are near-end channels in a communication pathway.

12. A method for acoustic echo cancellation, the method comprising:

receiving audio signals at a first channel and a second channel;

calculating, using a non-linear processor, a correlation between the audio signals received at the first channel and the second channel;

determining that an overdrive parameter for the first channel is higher than an overdrive parameter for the second channel;

updating the overdrive parameters for the first channel and the second channel;

calculating a suppression gain for the audio signal received at the first channel using the updated overdrive parameter for the first channel; and calculating a suppression gain for the audio signal received at the second channel using the updated overdrive parameter for the second channel.

13. The method of claim 12, wherein the overdrive parameters for the first channel and the second channel are updated using the calculated correlation between the audio signals.

14. The method of claim 13, wherein the overdrive parameter for the second channel is updated using the overdrive parameter of the first channel.

15. The method of claim 13, wherein the overdrive parameter for the first channel remains unchanged from the updating of the overdrive parameters.

16. The method of claim 12, further comprising calculating the overdrive parameters for the first channel and the second channel, wherein each of the overdrive parameters controls echo suppression rate for the respective channel.

17. The method of claim 12, wherein the first channel and the second channel are neighboring channels of a plurality of channels.

18. The method of claim 12, further comprising suppressing echo in each of the respective audio signals using the corresponding suppression gain calculated for the audio signal.

19. The method of claim 18, further comprising sending the respective echo-suppressed audio signals to respective audio output devices.

20. The method of claim 12, further comprising controlling echo suppression rate for the first channel and the second channel by adjusting the respective overdrive parameter.

* * * * *